US006684413B2

(12) United States Patent
Cascioli

(10) Patent No.: US 6,684,413 B2
(45) Date of Patent: Feb. 3, 2004

(54) SHOULDER HARNESS

(76) Inventor: Donato Cascioli, 76 Bridgeport Crescent, Ancaster, Ontario (CA), L9K 1K4

( * ) Notice: Subject to any disclaimer, the term of this patent is extended or adjusted under 35 U.S.C. 154(b) by 2 days.

(21) Appl. No.: 10/122,350

(22) Filed: Apr. 16, 2002

(65) Prior Publication Data

US 2002/0162872 A1 Nov. 7, 2002

Related U.S. Application Data

(60) Provisional application No. 60/287,736, filed on May 2, 2001.

(51) Int. Cl.[7] ..... A41F 9/00
(52) U.S. Cl. ..... 2/312
(58) Field of Search ..... 2/310–316, 326–328, 2/69, 460, 456, 108, 102; 182/3–5; 119/770, 857, 907; 244/151 R

(56) References Cited

U.S. PATENT DOCUMENTS

| | | | | | |
|---|---|---|---|---|---|
| 1,884,328 | A | | 10/1932 | Sperling | |
| 3,739,961 | A | | 6/1973 | Soukeras | 224/5 R |
| 4,324,205 | A | * | 4/1982 | Goldmacher | 2/300 |
| 5,080,191 | A | * | 1/1992 | Sanchez | 182/3 |
| 5,263,618 | A | | 11/1993 | Talavera | 224/148 |
| 5,289,896 | A | * | 3/1994 | Giglio | 182/3 |
| 5,361,953 | A | | 11/1994 | Nichols | 224/198 |
| 5,775,558 | A | | 7/1998 | Montalbano | 224/627 |
| 6,039,677 | A | * | 3/2000 | Spletzer | 482/105 |
| 6,106,016 | A | | 8/2000 | Bette | 281/45 |
| 6,125,792 | A | * | 10/2000 | Gee | 119/770 |

* cited by examiner

*Primary Examiner*—Tejash Patel

(57) ABSTRACT

The present invention a SHOULDER HARNESS comprises a torso mounted shoulder harness for carrying chest mounted objects, said shoulder harness including a horizontal strap encircling the upper torso and including horizontal strap ends for releasably connecting together for mounting and dismounting said shoulder harness; left and right vertical straps for positioning over respective left and right shoulders wherein each vertical strap connecting at the back to said horizontal strap, and each vertical strap connecting at the front to said horizontal strap. The shoulder harness further including locking clips attached proximate horizontal strap ends such that locking said locking clips together places said harness into a pre locked position; and front right and front left tabs, said tabs attached and extending parallel to said horizontal strap and mounted proximate horizontal strap ends, said tabs adapted to interlock together for imparting additional tension on said horizontal strap when said tabs interlocked together and placing said harness into a tensioned position, for preselectively tensioning said shoulder harness thereby adjusting the final tightness of said shoulder harness.

15 Claims, 10 Drawing Sheets

84
96
94
98
56

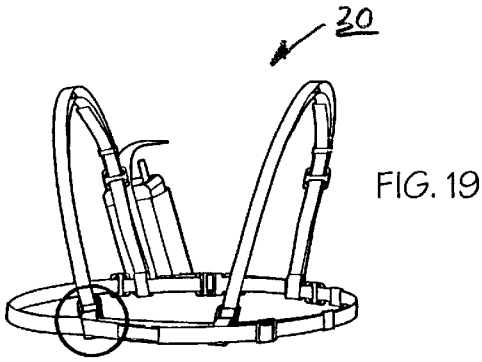
FIG. 19
FIG. 21
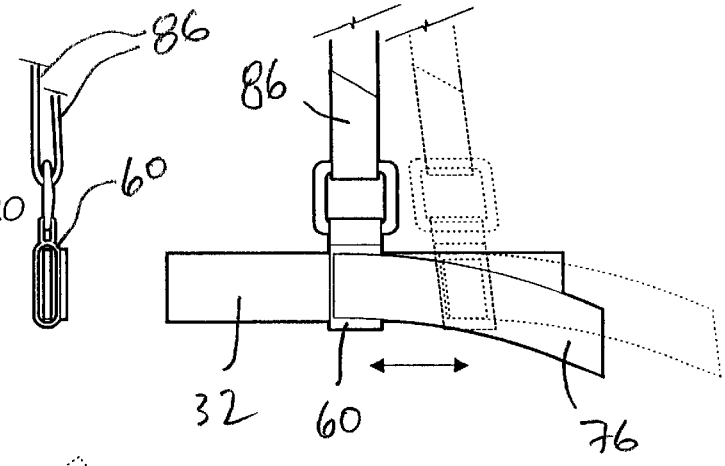
FIG. 20
FIG. 22
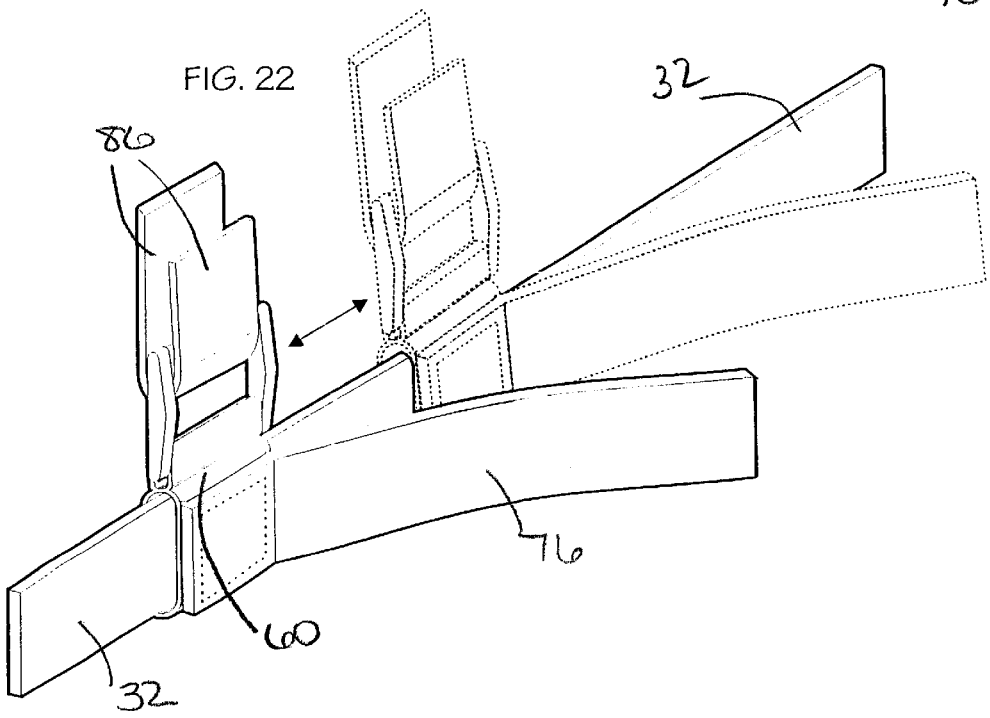

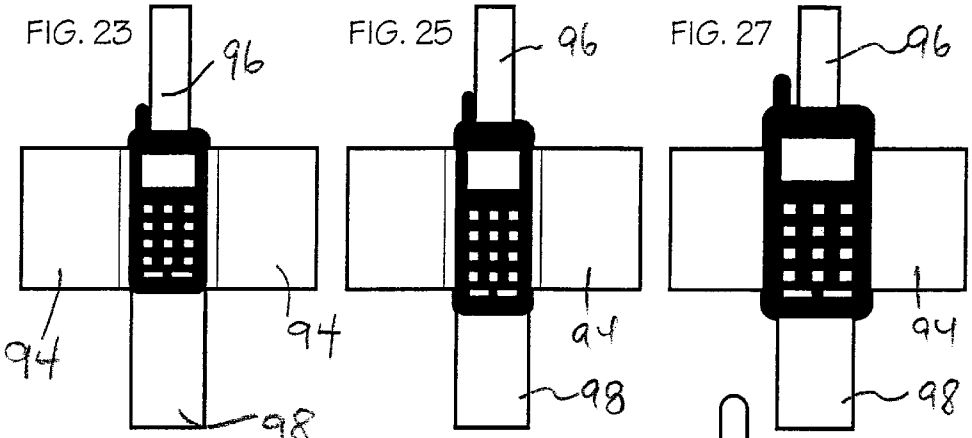
FIG. 23
FIG. 25
FIG. 27
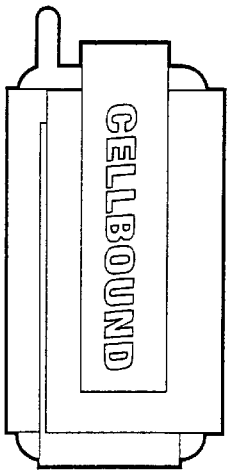
FIG. 24
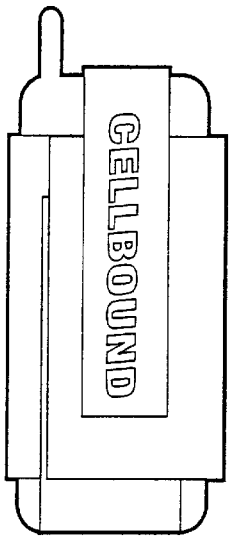
FIG. 26
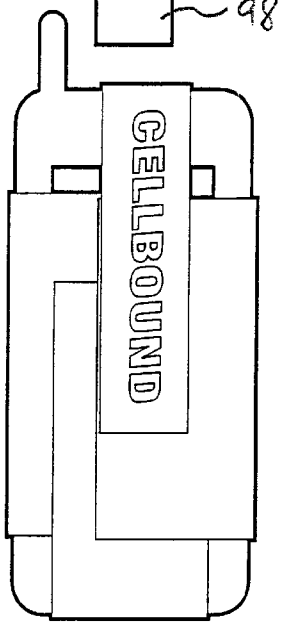
FIG. 28

SHOULDER HARNESS

This application claims the benefit of Provisional application Ser. No. 60/287,736, filed May 2, 2001.

FIELD OF THE INVENTION

The present invention relates to harnesses and more particularly to relates to shoulder harnesses.

BACKGROUND OF THE INVENTION

Body harnesses and shoulder harness are well known in the art and have been used and patented in various forms. Historically shoulder harness have been used particularly for carrying and concealing a weapon on a body, for example a pistol and the like. Shoulder harnesses have also been developed to carry other items such as back packs, pouches, devices for carrying bottled water, tools, books and other devices. Most of the shoulder harnesses are designed to conceal and/or to carry the object fairly low across the lower body of the person.

With the advent of paging devices, cellular telephones, two way radios and other modern communication devices, there is a need for a shoulder harness which will carry these devices high on the chest in the front of a person in order to be able to access them quickly and to make them more user friendly. Shoulder harnesses in particular are useful for people who are working in the outdoors such as on construction sites, in forested areas, in the country or on a farm where it is necessary to carry these communication devices. In these instances, the wearer preferably would like to have the device mounted high and easily accessible on the chest. The problem associated with shoulder harnesses of this kind is that the device must be firmly and securely positioned against the body and not allowed to swing freely or on its own, but rather maintain a very rigid and specific location and yet allow full body range.

Therefore, there is a need for a shoulder harness which can carry electronic devices such as pagers and cellular telephones high on the front of the chest of the person which is securely mounted onto the harness and attached to the body in such a manner that even for a persons carrying out heavy physical labour, the unit is securely mounted and tightly located against one portion of the chest or the body. Even with minimal action, belt hooks become ineffective being constantly removed in heavy use from belts, clips will weaken and/or break, not to mention constant readjustment required when sitting, driving or operation of equipment. Phones would also be left at job sites, lost, stolen or damaged because the phone would not be fully secured to body or it would also have to removed when operating equipment or driving, leaving it open to human error (ie. Lost, stolen, fallen).

SUMMARY OF THE INVENTION

The present invention a torso mounted shoulder harness for carrying chest mounted objects, said shoulder harness comprises:

a) a horizontal strap encircling the upper torso and including horizontal strap ends for releasably connecting together for mounting and dismounting said shoulder harness;

b) left and right vertical straps for positioning over respective left and right shoulders wherein each vertical strap connecting at the back to said horizontal strap, and each vertical strap connecting at the front to said horizontal strap;

c) a first means for locking and pre-tensioning said shoulder harness; and d) a second means for preselectively tensioning said shoulder harness thereby adjusting the final tightness of said shoulder harness.

Preferably wherein said shoulder harness including;

a) a carrying compartment connected to said shoulder harness and including a means for releasably holding objects.

Preferably wherein said shoulder harness including;

a) a means for adjusting said length of said horizontal strap.

Preferably wherein said shoulder harness including;

a) a means for adjusting said length of said vertical strap.

A torso mounted shoulder harness for carrying chest mounted objects, said shoulder harness comprising:

Preferably wherein said first locking means including locking clips attached proximate horizontal strap ends such that locking said locking clips together places said harness into a pre locked position.

Preferably said second tensioning means including front right and front left tabs, said tabs attached and extending parallel to said horizontal strap and mounted proximate horizontal strap ends, said tabs adapted to interlock together for imparting additional tension on said horizontal strap when said tabs interlocked together and placing said harness into a tensioned position.

Preferably said vertical straps attached to said horizontal strap with attachment loops such that said attachment loops adapted to slidably move along said horizontal strap.

Preferably wherein said tabs also adapted for urging front attachment loops of said vertical straps inwardly towards the centre of the torso when in said tensioned position.

Preferably wherein said front left tab attached to said front left attachment loop and said front right tab attached to said horizontal strap at a front tab buckle, said buckle adapted for adjusting said length of said front right tab.

Preferably wherein said front tab buckle further for urging said front right loop inwardly toward the centre of the torso along said horizontal strap when said front tabs urged into said tensioned position.

Preferably wherein said second tensioning means including right back tab and left back tabs, said tabs attached and extending parallel to said horizontal strap, said tabs adapted to interlock together for imparting additional tension on said horizontal strap when said tabs interlocked together and placing said harness into a tensioned position.

Preferably wherein said back tabs mounted at one end to each back attachment loop such that said back tabs adapted for pulling back attachment loops of said vertical straps inwardly towards the centre of the torso when in said tensioned position.

Preferably wherein said shoulder harness further including a carrying compartment connected to said shoulder harness and including a means for releasably holding objects.

Preferably wherein said carrying compartment defined by a bottom flap, a top flap, and two side flaps adapted for releasably folding and attaching onto each other for defining said carrying compartment and holding an object within said folded and interlocked flaps such that the degree of overlap determines the size of the carrying compartment.

Preferably wherein said flaps including Velcro™ type fastening material attached to each flap for interlocking with an adjacent flap when folded onto each other.

Preferably wherein said shoulder harness including a means for adjusting said length of said vertical strap.

Preferably wherein said shoulder harness including a means for adjusting said length of said horizontal strap.

Preferably further including elastic portions defined in said horizontal and vertical straps for aiding in maintaining said harness in said tensioned position.

Preferably wherein said carrying compartment adapted for carrying rectangular and square shaped objects.

Preferably wherein said carrying compartment adapted for carrying cell telephones or two way radios.

BRIEF DESCRIPTION OF THE DRAWINGS

The invention will now be described by way of example only with reference to the following drawings in which:

FIG. 19 is a back perspective view of the shoulder harness.

FIG. 20 is a side elevational view of the back left attachment loop detail.

FIG. 21 is a back plan view of the back left attachment loop detail.

FIG. 22 is a side elevational view of the back left vertical strap together with the horizontal strap and the back left attachment loop.

FIG. 23 is a front plan elevational view of the carrying compartment together with a cell phone.

FIG. 24 is a front elevational view of the carrying compartment in the closed position.

FIG. 25 is a front elevational plan view of the carrying compartment in the open position together with a cell phone.

FIG. 26 is a front elevational view of the carrying compartment together with the cell phone in the closed position.

FIG. 27 is a front plan elevational view of the carrying compartment in the open position together with a cell phone.

FIG. 28 is front elevational plan view of the carrying compartment in the closed position together with a cell phone.

DETAILED DESCRIPTION OF PREFERRED EMBODIMENT

Figures 1, 2, 3, 4:
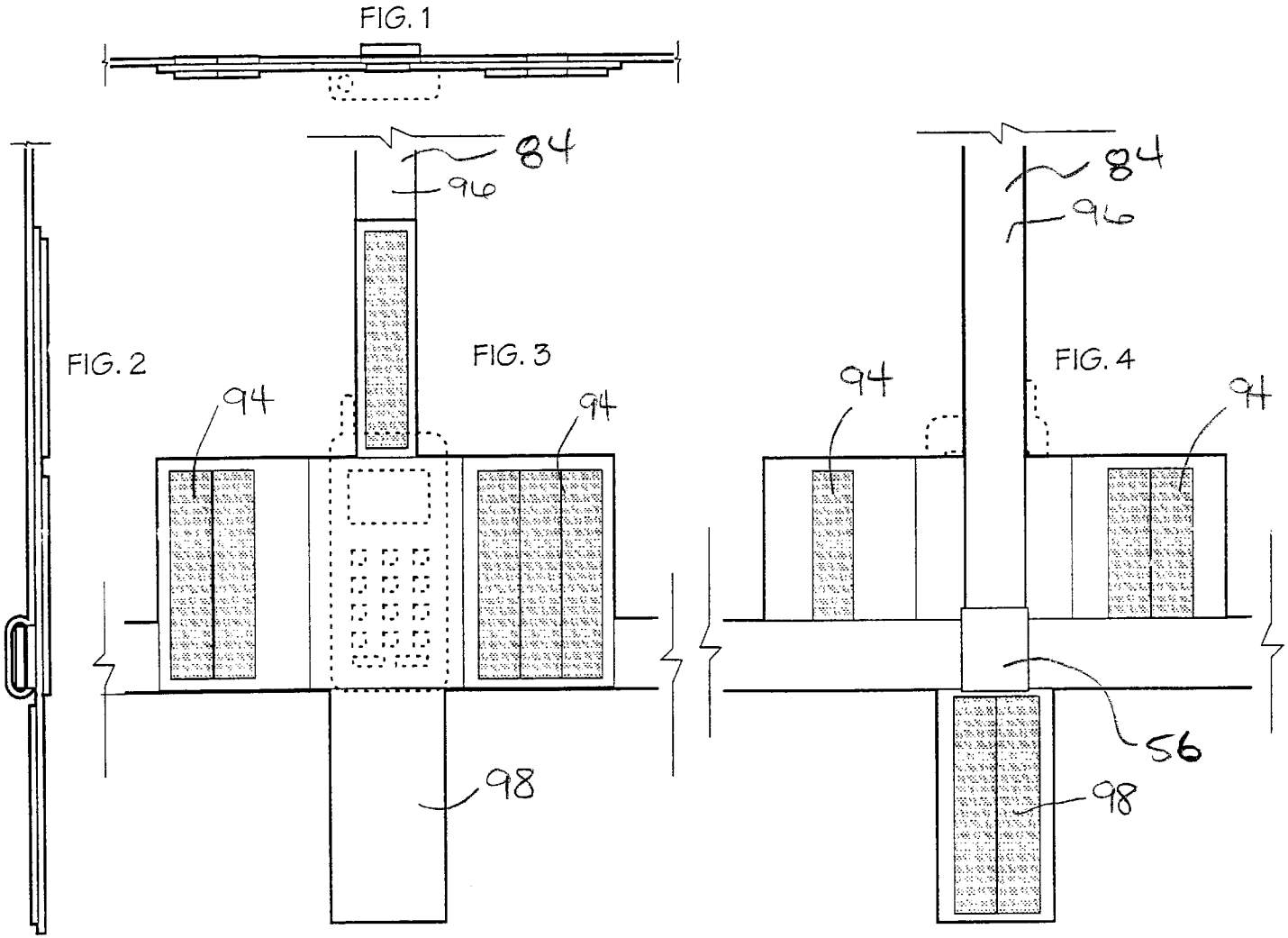
FIG. 1 is a top plan view of the carrying compartment.
FIG. 2 is a bottom plan view of the carrying compartment shown in FIG. 3.
FIG. 3 is a front elevational view of the carrying compartment in the open position.
FIG. 4 is a back elevational view of the carrying compartment in the open position.

The present invention a Shoulder Harness shown generally as 30 includes the following major components, namely: horizontal strap 32, vertical straps 38, carrying compartment 44, front tightening tabs 48 and back tightening tabs 46.

Figure 17:
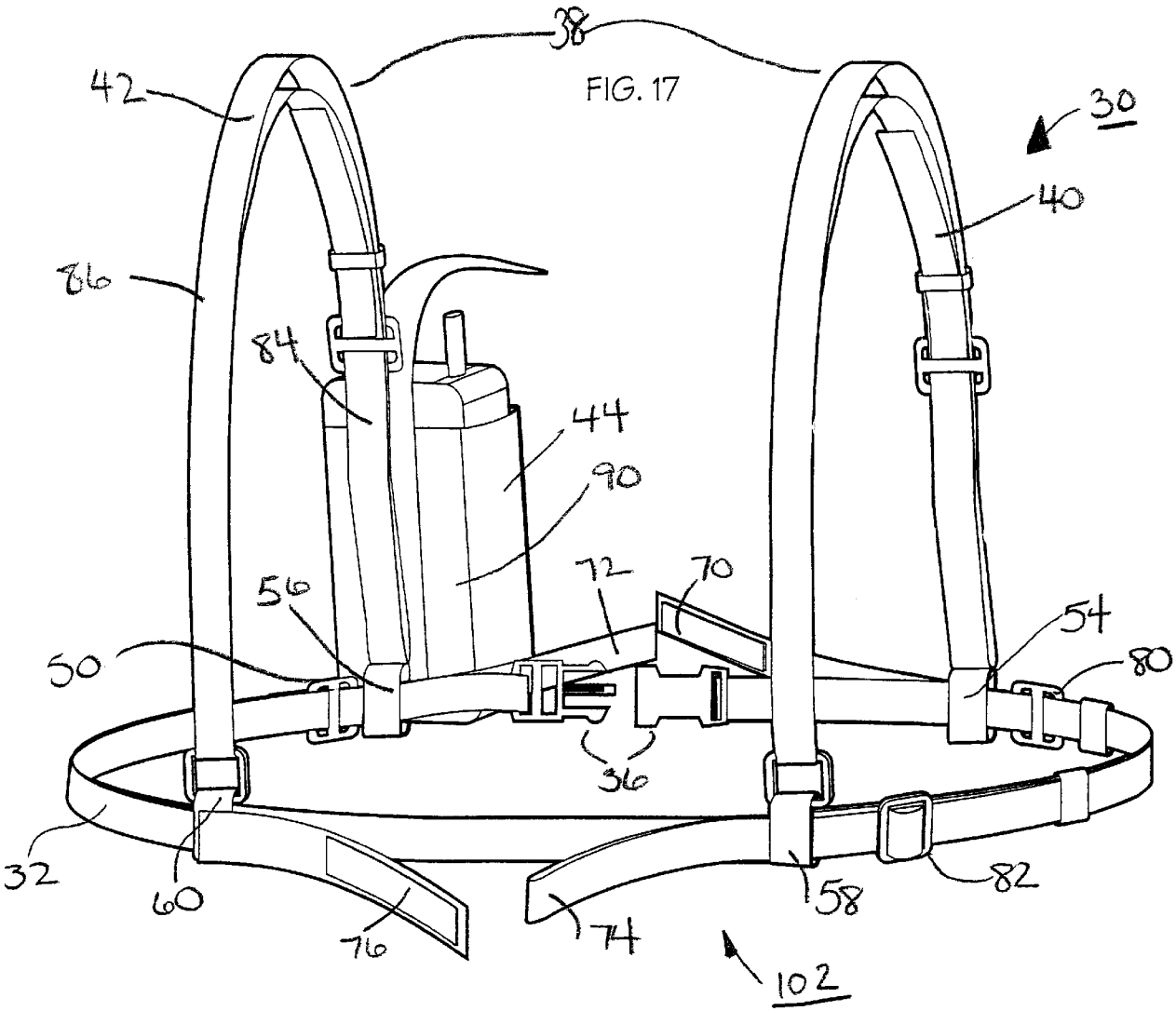
FIG. 17 is a back perspective view of the shoulder harness shown in the released position.
Figure 18:
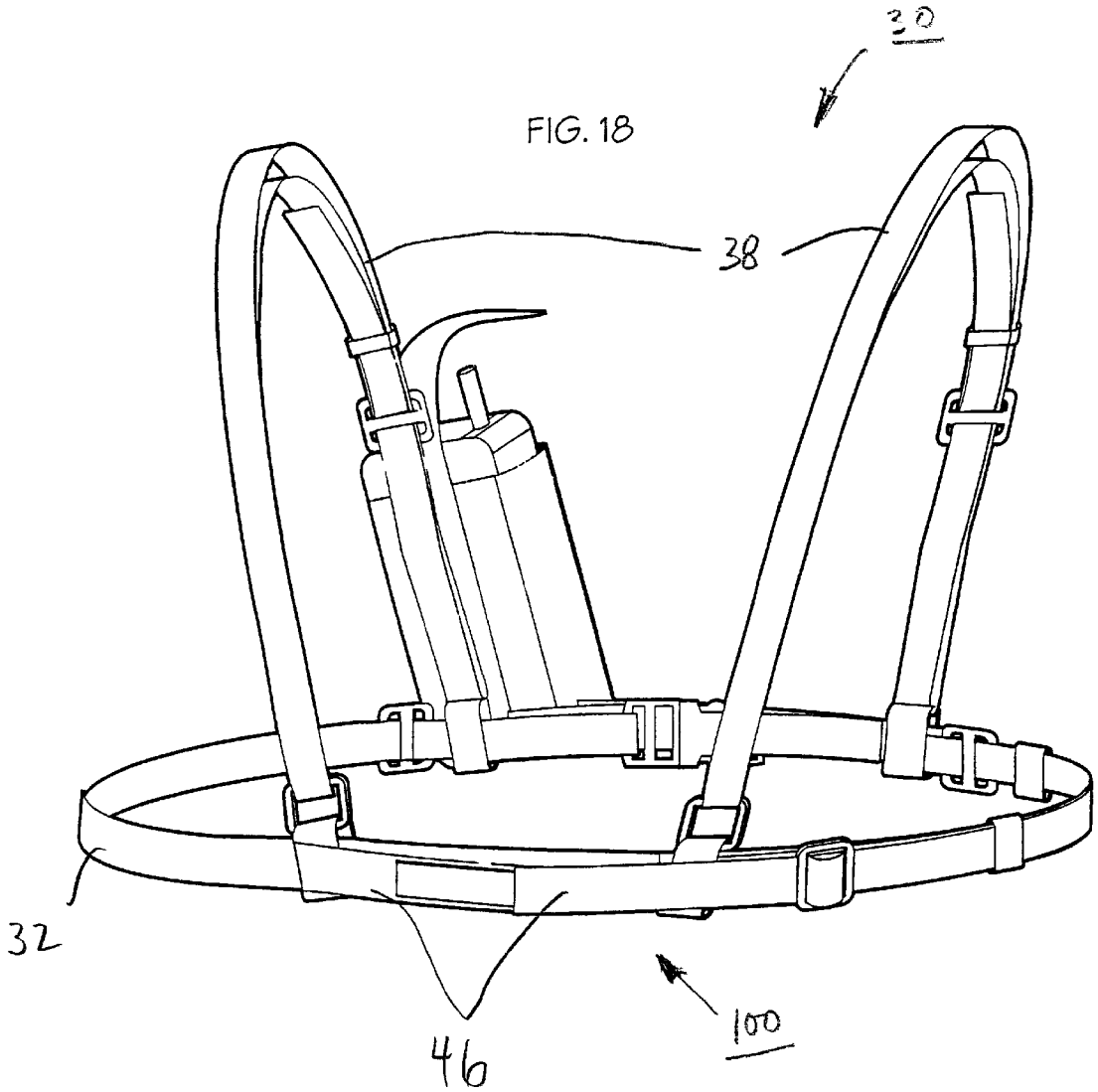
FIG. 18 is a back perspective view of the shoulder harness in the tensioned position.

Horizontal strap 32 is a more or less a continuous strap which circles the upper torso of a person as shown in FIGS. 9 through 14 and includes horizontal strap ends 34 which have mounted thereon a locking clip 36 in order to lock together the horizontal strap ends 34 of horizontal strap 32. The length of horizontal strap 32 is adjusted with horizontal strap buckle 50 as shown in FIG. 17.

Vertical straps 38 include a right vertical strap 40 and a left vertical strap 42. Vertical straps 38 are connected to horizontal strap 32 using attachment loops 52 as shown best in FIGS. 15 and 17. Right vertical strap 40 is attached in the back with back right attachment loop 58 and in the front with front right attachment loop 54. Left vertical strap 42 is attached at the back with back left attachment loop 60 and at the front with front left attachment loop 56. The length of vertical straps 38 can be adjusted using vertical buckle 62 on each vertical strap in order to accommodate any size and shape of torso.

Front tightening tabs 48 include front right tab 70 and front left tab 72 which are cooperatively inter connectable using Velcro™ 78 on opposing surfaces of each tab respectively. Back tightening tabs 46 include right back tab 74 and left back tab 76 again which cooperatively interlock using Velcro™ fasteners on opposing surfaces.

The length of front right tab 70 is adjusted using front tab buckle 80 and the length of right back tab is adjusted using rear tab buckle 82. Front left tab 72 is rigidly connected to front left attachment loop 56 which in turn is connected to front left vertical strap 84 which in turn is connected to the rear side 90 of carrying compartment 44. In other words as best shown in FIG. 17 carrying compartment 44 is attached to the front left vertical strap 84 and also to front left tab 72 and is also connected to front left attachment loop 56 which is free to move slidably along horizontal strap 32.

As best shown in FIGS. 19 through 22, left back tab 76 is rigidly connected to back left attachment loop 60 which connects left back vertical strap 86 to horizontal strap 32. In this manner back left attachment loop 60 is free to move slidably along horizontal strap 32 while remaining attached to left back tab 76 as well as back left vertical strap 86.

Figure 8:
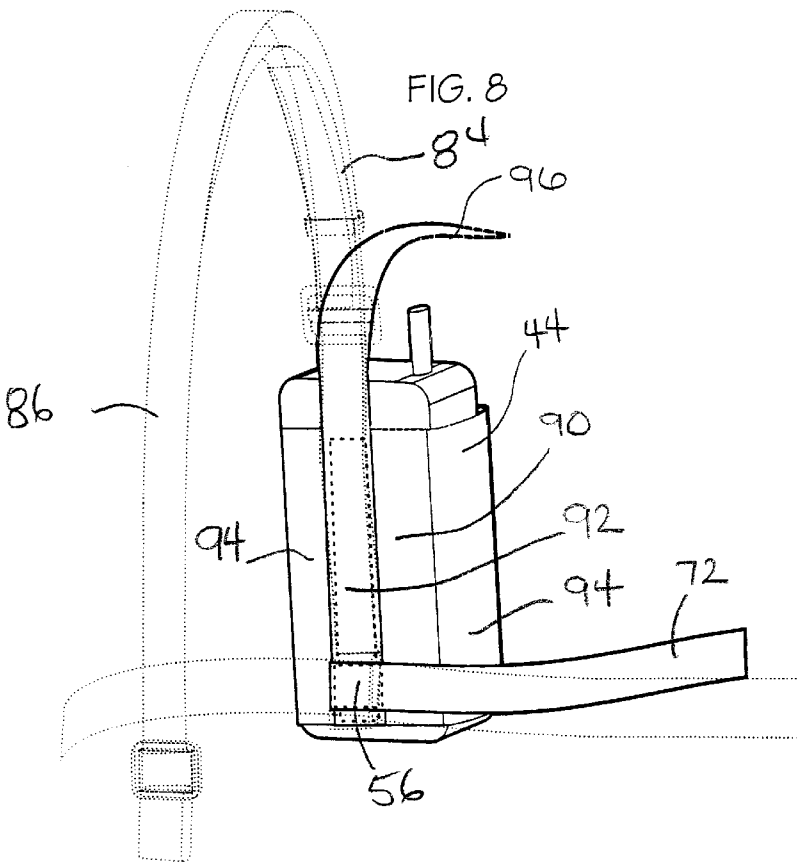
FIG. 8 is a back perspective view of the carrying compartment together with the vertical strap and portion of the horizontal strap.
Figure 5:
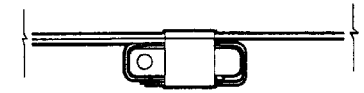
FIG. 5 is a top plan view of the carrying compartment in the closed position.
Figure 6:
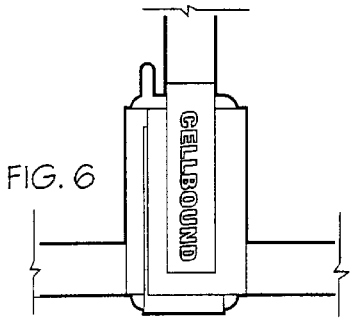
FIG. 6 is a front elevational view of the carrying compartment in the closed position.
Figure 7:
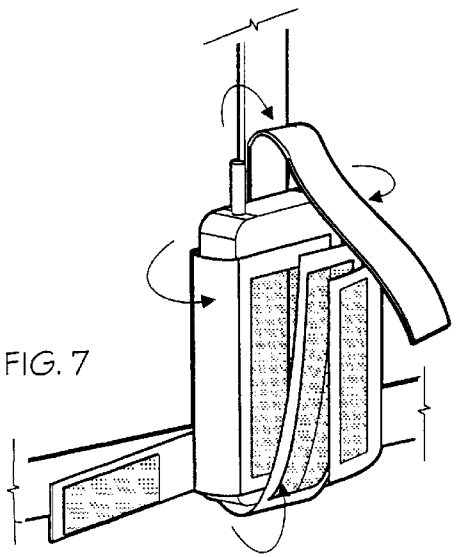
FIG. 7 is a front perspective view of the carrying compartment.
Figure 11:
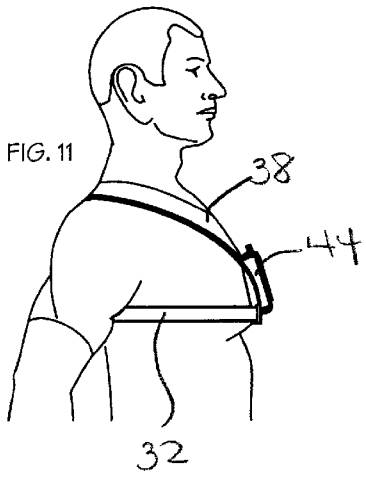
FIG. 11 is a side elevational view of the shoulder harness mounted on a person.
Figure 15:
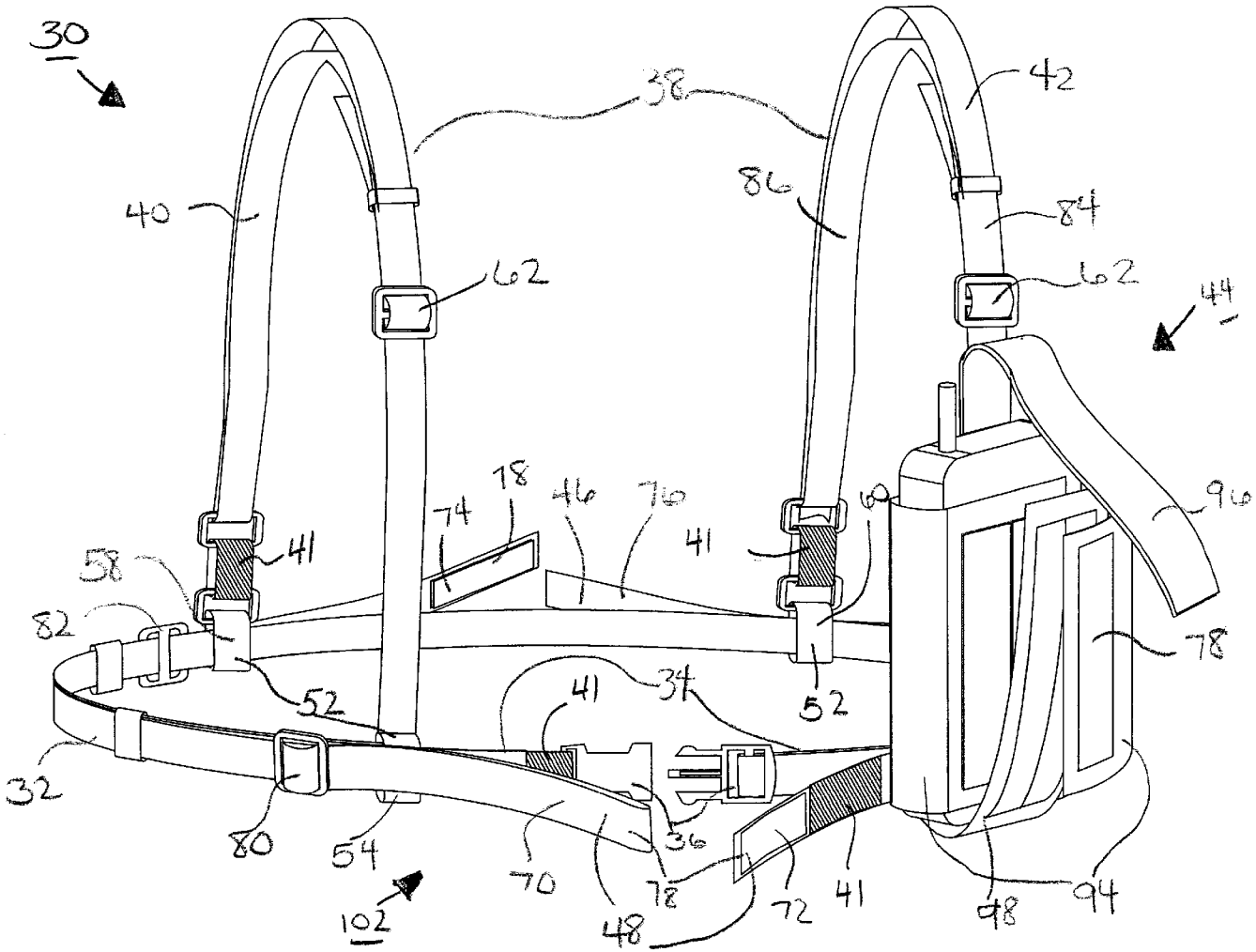
FIG. 15 is a front perspective view of the shoulder harness shown in the released position.

Carrying compartment 44 is comprised of four flaps, namely top flap 96, bottom flap 98 and two side pocket flaps 94. Carrying compartment 45 is preferably made from a unitary piece of material having a rear side 90 and is attached together to front left vertical strap 84 at attachment area 92 as best shown in FIG. 8 which are sewn or attached to front left tab 72. The surfaces of the flaps mentioned above have Velcro™ 78 material mounted on the surfaces thereof such that when side pocket flaps 94 are folded upon each other as shown in FIG. 15, they adhere via male and female Velcro™ surfaces as well bottom flap 98 also contains Velcro™ on one side and finally top flap 96 contains Velcro™ on the inner side to mesh with the Velcro™ mounted onto the other flap.

As shown in FIGS. 23 through 31, carrying compartment 44 preferably is constructed out of a single piece of material which is cut in a cross shape shown in FIG. 23 having side flaps 94, bottom flap 98, a top flap 96 and a common rear side 90 which holds all the flaps together.

Referring now to FIG. 3 which shows from a front view the carrying compartment 44 comprised of a top flap 96, a side flap 94, and a bottom flap 98 all shown in the open position in which top flap 96 and side flaps 94 are shown with Velcro™ mounted thereon.

FIG. 4 shows carrying compartment 44 from the backside in the open position with the flaps laying flat wherein bottom flap 98 and side flaps 94 are shown with Velcro™ mounted thereon. In FIG. 4, top flap 96 for example is showing no Velcro™ mounted on the outside surface of top flap since this is the last flap closed upon the others. Side flaps 94 have Velcro™ mounted on the front and back surfaces of these flaps, whereas bottom flap 98 only has Velcro™ mounted on the backside of the flap and top flap 96 only has Velcro™ mounted on the front side of the flap.

In Use

Figure 10:
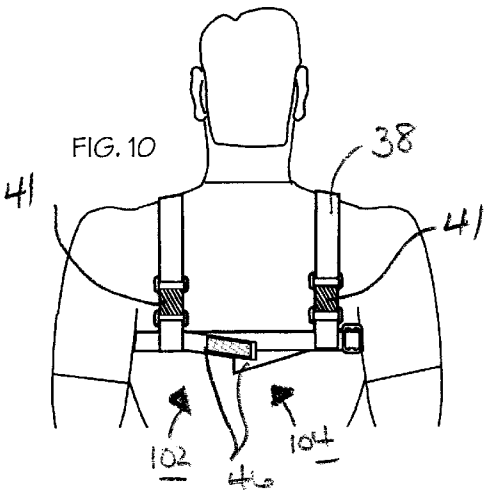
FIG. 10 is a back plan view of the shoulder harness deployed on a person shown in the pre-tightened position.
Figure 9:
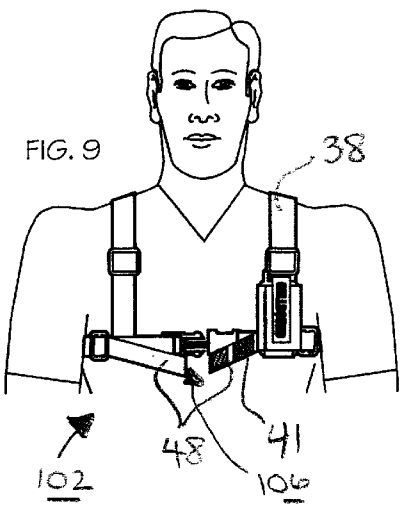
FIG. 9 is a front view of the shoulder harness shown deployed on a person in the pre-locked position.
Figure 14:
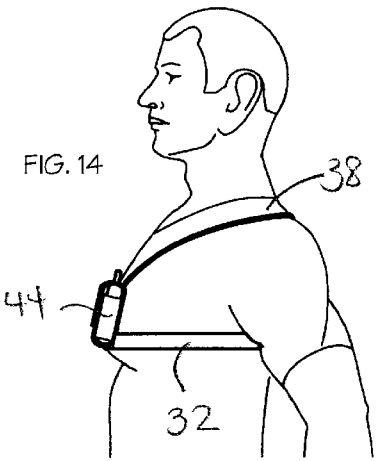
FIG. 14 is a side elevational view of the shoulder harness deployed on a person.
Figure 16:
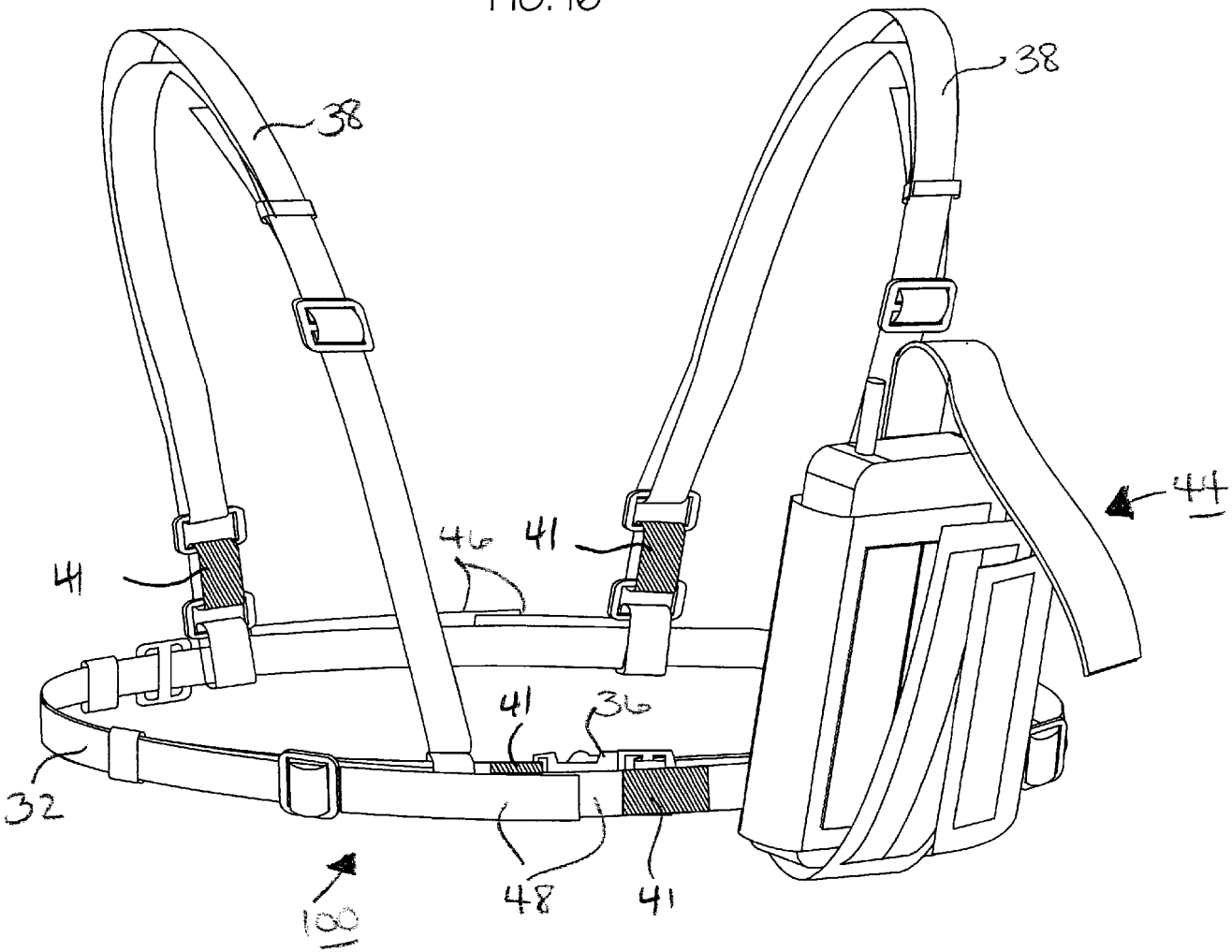
FIG. 16 is a front perspective view of the shoulder harness shown in the tensioned position.

FIG. 15 shows shoulder harness 30 with the tightening tabs in released position 102. FIG. 16 shows the tightening tabs in tensioned position 100. FIGS. 9 through 14 show shoulder harness 30 mounted onto the torso of a person. Locking clip 36 is shown in the unlocked position and tightening tabs in the released position 102 in FIG. 15. Horizontal strap 32 is pre-adjusted to fit snugly around persons torso by adjusting the length of horizontal strap 32 with horizontal strap buckle 50. Similarly vertical straps 38 are adjusted to fit comfortably onto a persons torso by adjusting the length of vertical straps 38 using vertical buckles 62 on each vertical strap 38. With vertical straps 38 and horizontal strap 32 pre-adjusted to fit snugly onto the person, shoulder harness 30 is worn by placing the vertical straps over each shoulder and the horizontal strap 32 circling the torso of a person as shown in FIG. 9 with the entire unit in the pre-locked position 106. Clipping together locking clip 36 to lock horizontal strap ends 34 of horizontal strap 32 places shoulder harness 30 into the locked and pre-tensioned position 104 as shown in FIG. 10. In this position locking clip 36 has been locked together, however, tightening tabs are in the released position 102. Unfortunately, one cannot get a snug enough fit by only using this locking system in that there will always be slack between the vertical straps 38 and the horizontal straps 32 when mounting shoulder harness 30 is in the locked and pre-tensioned position 104. Therefore, further tensioning is required which is accomplished by placing tightening tabs in the tensioned position 100 as shown in FIG. 16 and also in FIGS. 12 and 13.

Figure 13:
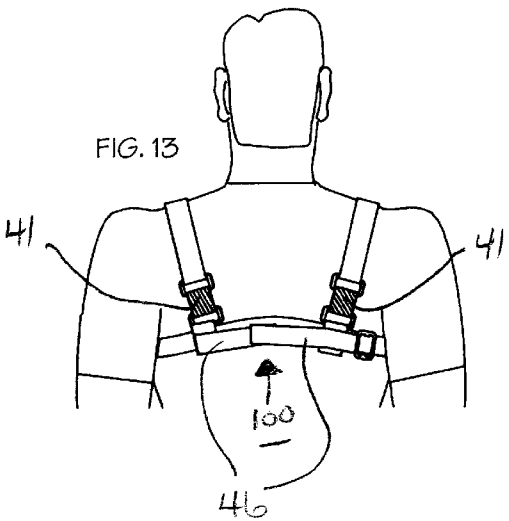
FIG. 13 is a back plan elevational view of the shoulder harness deployed on a person in the tensioned position.
Figure 12:
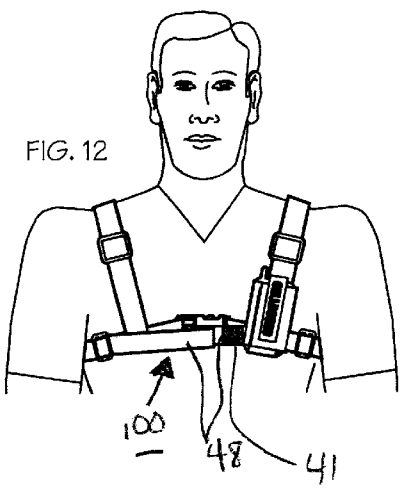
FIG. 12 is a front elevational view of the shoulder harness deployed on a person in the tensioned position.

To further restrict the movement of the attachment loops 52, along horizontal strap 32, first the length of front right tab 70 and the right back tab 74 is adjusted using front tab buckle 80 and rear tab buckle 82 respectively. By shortening the length of front right tab 70 and right back tab 74, a greater amount of tension can be placed on shoulder harness 30. Moving the tightening tabs from released position 102 to the tensioned position 100, pulls the ends of vertical straps 38 which are attached to attachment loops 52 inwardly towards the centre of the torso by the impingement of front tab buckle 80 onto front right attachment loop 54 and the impingement of rear tab buckle 82 onto back right attachment loop 58 thereby urging the attachment loops towards the centre of the torso. The left vertical strap 42 and one end of front left tab 72 is attached to front left attachment loop 56 therefore placing front tightening tabs 48 into the tensioned position 102 urges the end of front left vertical strap 84 towards the centre of the torso. Left back tab 76 is attached to back left attachment loop 60, therefore placing back tightening tabs 48 into the tensioned position 102 urges the end of back left vertical strap 86 towards the centre of the torso. Therefore, rather than the vertical straps 38 lying in vertical alignment as shown in FIGS. 9 and 10, they are pulled towards the centre of the torso and form a slight V or angular configuration across the body as shown in FIGS. 12 and 13 and as well horizontal strap 32 due to the tension exerted by placing tightening tabs in tensioned position 100 lifts horizontal strap 32 upwardly near the front centre and rear centre portions.

This two stage fastening system is required in order to obtain the proper amount of tension onto horizontal strap 32 as well as vertical straps 38.

The first means for locking the shoulder harness 30 onto a torso is accomplished by engaging locking clip 36 and the second means for tensioning shoulder harness 30 is accomplished by placing tightening tabs from the released position 102 into the tensioned position 100 as shown in FIGS. 15 and 16 as well as in FIGS. 9 through 14.

In this manner the amount of tension on shoulder harness 30 can be easily controlled by the wearer by simply adjusting the length of front right tab 70 using front tab buckle 80 and the length of back right tab 74 using rear tab buckle 82. In this manner, a custom fit is accomplished for every particular size and shape of body, thereby ensuring a tight fit for the harness.

Tensioning is particularly important when carrying compartment 44 is holding a heavy object which needs to be restrained from moving about randomly. Optionally elastic portions 41 as shown in the Figures on horizontal strap 32 and/or vertical straps 38 aid in maintaining tension on shoulder harness 30 in the tensioned position 100.

Referring to FIGS. 1 through 8 as well as FIGS. 15, 17 and also 23 through 31 which show the details of carrying compartment 44. Carrying compartment 44 preferably has four flaps, namely bottom flap 98, top flap 96 and side flaps 94 which define the interior of carrying compartment 44. Preferably carrying compartment 44 is comprised of one piece of material which is in a cross shape having a rear side 90 from which the flaps emanate from. Referring to FIG. 8 in particular, carrying compartment 44 is sewn onto front left vertical strap 84 at attachment area 92. In addition, front left tab 72 is also sewn onto attachment area 92 via a front left attachment loop 56. As shown in FIGS. 5 through 8, a cell phone for example can be placed into carrying compartment 44 by firstly folding over a side flap 94, then the bottom flap 98 is folded upward, then the second side flap 94 is folded inwardly and finally, top flap 96 is folded downwardly all of which are positively held in place with male and female Velcro™ tabs which are sewn onto each flap.

As shown in FIGS. 23 through 28, various sizes of cell phones can be held by carrying compartment 44 without the need for changing the size or the length of the flaps 94, 96 and 98.

Figure 31:
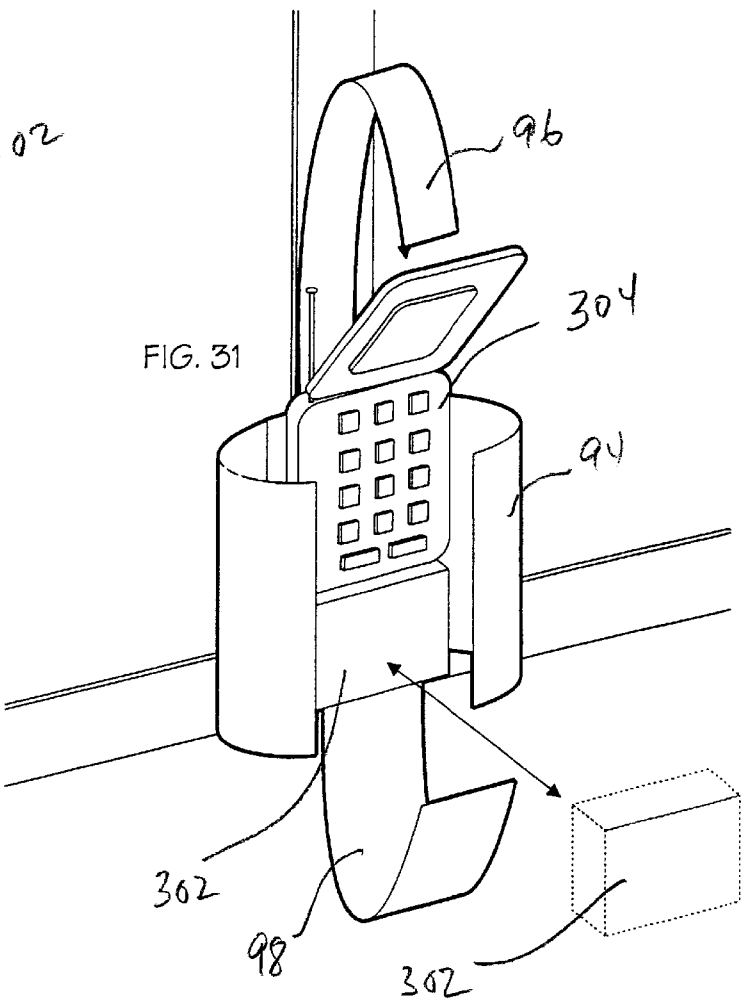
FIG. 31 is a front perspective elevational view of the carrying compartment together with the horizontal strap and the vertical strap and the carrying compartment in the open position.
Figure 29:
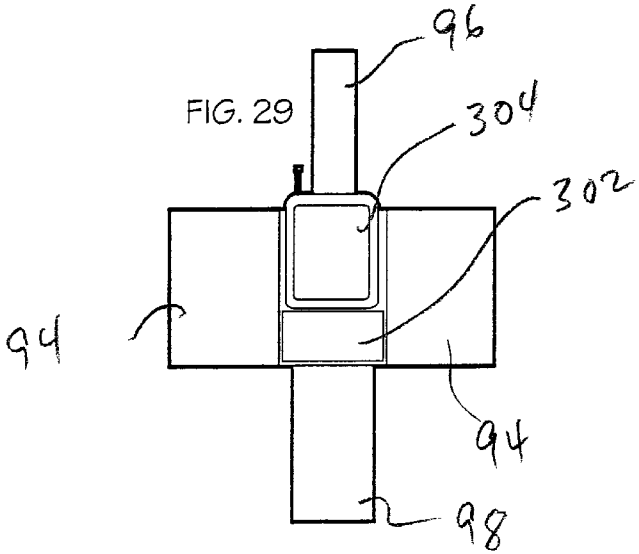
FIG. 29 is a front plan elevational view of the carrying compartment in the open position with a cell phone.
Figure 30:
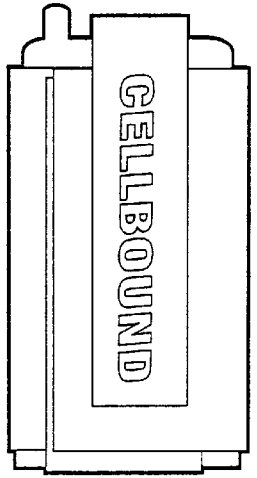
FIG. 30 is a front plan elevational view of the carrying compartment in the closed position.

As shown in FIGS. 29 through 31, a small flip phone 304 can also be housed within carrying compartment 44 by using a foam insert 302 in order to take up the excess space.

In addition, there is no reason why carrying compartment cannot hold other articles, such as two-way radios, water bottles, cassette players, walkmans, CD players and/or other items and the shape of carrying compartment 44 can be varied in order to accommodate any size or shape of article one wishes to hold. The rectangular shape shown in the Figures is by way of example only and round, square and other odd shaped articles can be placed within a carrying compartment 44 which may or may not be modified in order to hold articles of different sizes.

It should be apparent to persons skilled in the arts that various modifications and adaptation of this structure described above are possible without departure from the spirit of the invention the scope of which defined in the appended claim.

I claim:

1. A torso mounted shoulder harness for carrying chest mounted objects, said shoulder harness comprising:

a) a horizontal strap encircling the upper torso and including horizontal strap ends for releasably connecting together for mounting and dismounting said shoulder harness;

b) left and right vertical straps for positioning over respective left and right shoulders wherein each vertical strap connecting at the back to said horizontal strap, and each vertical strap connecting at the front to said horizontal strap;

c) a first means for locking and pre-tensioning said shoulder harness;

d) a second means for preselectively tensioning said shoulder harness thereby adjusting the final tightness of said shoulder harness;

e) wherein said first locking means including locking clips attached proximate horizontal strap ends such that locking said locking clips together places said harness into a pre locked position;

f) wherein said second tensioning means including front right and front left tabs, said tabs attached and extending parallel to said horizontal strap and mounted proximate horizontal strap ends, said tabs adapted to interlock together for imparting additional tension on said horizontal strap when said tabs interlocked together and placing said harness into a tensioned position;

g) wherein said vertical straps attached to said horizontal strap with attachment loops such that said attachment loops adapted to slidably move along said horizontal strap;

h) wherein said tabs also adapted for urging front attachment loops of said vertical straps inwardly towards the centre of the torso when in said tensioned position;

i) wherein said front left tab attached to said front left attachment loop and said front right tab attached to said horizontal strap at a front tab buckle, said buckle adapted for adjusting said length of said front right tab;

j) wherein said front tab buckle further for urging said front right loop inwardly toward the centre of the torso along said horizontal strap when said front tabs urged into said tensioned position;

k) wherein said second tensioning means including right back tab and left back tabs, said tabs attached and extending parallel to said horizontal strap, said tabs adapted to interlock together for imparting additional tension on said horizontal strap when said tabs interlocked together and placing said harness into a tensioned position;

l) wherein said back tabs mounted at one end to each back attachment loop such that said back tabs adapted for pulling back attachment loops of said vertical straps inwardly towards the centre of the torso when in said tensioned position;

m) wherein said shoulder harness further including a carrying compartment connected to said shoulder harness and including a means for releasably holding objects; and n) wherein said carrying compartment defined by a bottom flap, a top flap, and two side flaps adapted for releasably folding and attaching onto each other for defining said carrying compartment and holding an object within said folded and interlocked flaps such that the degree of overlap determines the size of the carrying department.

2. The torso mounted shoulder harness for carrying chest mounted objects claimed in claim 1 wherein said first locking means including locking clips attached proximate horizontal strap ends such that locking said locking clips together places said harness into a pre locked position.

3. The torso mounted shoulder harness for carrying chest mounted objects claimed in claim 2 wherein said second tensioning means including front right and front left tabs, said tabs attached and extending parallel to said horizontal strap and mounted proximate horizontal strap ends, said tabs adapted to interlock together for imparting additional tension on said horizontal strap when said tabs interlocked together and placing said harness into a tensioned position.

4. The torso mounted shoulder harness for carrying chest mounted objects claimed in claim 3 wherein said vertical straps attached to said horizontal strap with attachment loops such that said attachment loops adapted to slidably move along said horizontal strap.

5. The torso mounted shoulder harness for carrying chest mounted objects claimed in claim 4 wherein said tabs also adapted for urging front attachment loops of said vertical straps inwardly towards the centre of the torso when in said tensioned position.

6. The torso mounted shoulder harness for carrying chest mounted objects claimed in claim 5 wherein said front left tab attached to said front left attachment loop and said front right tab attached to said horizontal strap at a front tab buckle, said buckle adapted for adjusting said length of said front right tab.

7. The torso mounted shoulder harness for carrying chest mounted objects claimed in claim 6 wherein said front tab buckle further for urging said front right loop inwardly toward the centre of the torso along said horizontal strap when said front tabs urged into said tensioned position.

8. The torso mounted shoulder harness for carrying chest mounted objects claimed in claim 7 wherein said second tensioning means including right back tab and left back tabs, said tabs attached and extending parallel to said horizontal strap, said tabs adapted to interlock together for imparting additional tension on said horizontal strap when said tabs interlocked together and placing said harness into a tensioned position.

9. The torso mounted shoulder harness for carrying chest mounted objects claimed in claim 8 wherein said back tabs mounted at one end to each back attachment loop such that said back tabs adapted for pulling back attachment loops of said vertical straps inwardly towards the centre of the torso when in said tensioned position.

10. The torso mounted shoulder harness for carrying chest mounted objects claimed in claim 9 wherein said shoulder harness further including a carrying compartment connected to said shoulder harness and including a means for releasably holding objects.

11. The torso mounted shoulder harness for carrying chest mounted objects claimed in claim 10 wherein said carrying compartment defined by a bottom flap, a top flap, and two side flaps adapted for releasably folding and attaching onto each other for defining said carrying compartment and holding an object within said folded and interlocked flaps such that the degree of overlap determines the size of the carrying compartment.

12. The torso mounted shoulder harness for carrying chest mounted objects claimed in claim 1 wherein said flaps including hook and loop fasteners type fastening material attached to each flap for interlocking with an adjacent flap when folded onto each other.

13. The torso mounted shoulder harness for carrying chest mounted objects claimed in claim 12 wherein said shoulder harness including a means for adjusting said length of said vertical strap.

14. The torso mounted shoulder harness for carrying chest mounted objects claimed in claim 13 wherein said shoulder harness including a means for adjusting said length of said horizontal strap.

15. The torso mounted shoulder harness for carrying chest mounted objects claimed in claim 14 further including elastic portions defined in said horizontal and vertical straps for aiding in maintaining said harness in said tensioned position.

* * * * *